US009346610B2

(12) United States Patent
Nelson

(10) Patent No.: US 9,346,610 B2
(45) Date of Patent: May 24, 2016

(54) VARIABLE VOLUME CONTAINER

(71) Applicant: James Nelson, Mira Loma, CA (US)

(72) Inventor: James Nelson, Mira Loma, CA (US)

( * ) Notice: Subject to any disclaimer, the term of this patent is extended or adjusted under 35 U.S.C. 154(b) by 352 days.

(21) Appl. No.: 14/169,403

(22) Filed: Jan. 31, 2014

(65) Prior Publication Data

US 2014/0263315 A1 Sep. 18, 2014

Related U.S. Application Data

(60) Provisional application No. 61/785,130, filed on Mar. 14, 2013.

(51) Int. Cl.

| | |
|---|---|
| ***B65D 88/46*** | (2006.01) |
| ***B65D 88/44*** | (2006.01) |
| ***B65D 41/32*** | (2006.01) |
| ***B65D 85/72*** | (2006.01) |
| ***B65D 81/20*** | (2006.01) |

(52) U.S. Cl.

CPC ..... *B65D 85/72* (2013.01); *B65D 81/2015* (2013.01)

(58) Field of Classification Search

CPC ..... B65D 1/0292; B65D 11/04; B65D 21/08; B65D 5/0005; B65D 7/045; B65D 79/005; B65D 88/62

USPC ..... 215/381, 382; 220/203.11, 530, 680, 220/623, 624, 666, 669, 675, 757

See application file for complete search history.

(56) References Cited

U.S. PATENT DOCUMENTS

| | | | | |
|---|---|---|---|---|
| 972,095 | A | 10/1910 | Booth | |
| 3,811,460 | A * | 5/1974 | Capdevielle | B65D 88/62 137/255 |
| 4,037,752 | A | 7/1977 | Dulmaine | |
| 4,108,324 | A | 8/1978 | Krishnakumar | |
| 4,134,510 | A | 1/1979 | Chang | |
| 4,525,401 | A | 6/1985 | Pocock | |
| 4,667,454 | A * | 5/1987 | McHenry | B65D 55/02 426/401 |
| 4,892,205 | A | 1/1990 | Powers | |
| 5,205,434 | A * | 4/1993 | Brunson | B65D 1/0284 215/375 |
| 5,397,021 | A | 3/1995 | Usui | |
| 5,763,030 | A * | 6/1998 | Matsui | B29C 49/48 215/374 |
| 7,416,088 | B2 * | 8/2008 | Boukobza | B65D 1/0276 215/371 |
| 7,416,089 | B2 * | 8/2008 | Kraft | B65D 1/0276 215/373 |
| 7,654,402 | B2 | 2/2010 | Kusuma | |

(Continued)

FOREIGN PATENT DOCUMENTS

| | | |
|---|---|---|
| EP | 1544128 A1 | 6/2005 |
| EP | 2205499 B1 | 6/2012 |

*Primary Examiner* — Anthony Stashick
*Assistant Examiner* — Kaushikkumar Desai
(74) *Attorney, Agent, or Firm* — Trojan Law Offices

(57) ABSTRACT

A variable volume container comprises a sidewall, a base having a ribbed region, and a diaphragm. The ribbed region has a plurality of concentric ribs extending from the diaphragm, and flexure zones between each rib. The flexure zones allow for accordion-like movement of the diaphragm in response to the internal pressure of the container. The ribs are characterized has having a uniformly arced interior curved surface and a distorted arced exterior curved surface. The ribs are four to eight times the width of the flexure zones, and the flexure zones have an exterior surface shorter than its bottom surface. During vacuum sealing, these features allow the diaphragm to retract upward to reduce the volume of the container while maintaining shape and structural stability of the container. This is especially useful for food packaging operations where containers need to be able to withstand conditions such as high pressure, heat, and/or vacuums.

12 Claims, 5 Drawing Sheets

(56) References Cited

U.S. PATENT DOCUMENTS

| | | | | |
|---|---|---|---|---|
| 2012/0037661 | A1 | 2/2012 | Mays | |
| 2013/0043202 | A1 | 2/2013 | Wurster | |
| 2013/0043209 | A1 | 2/2013 | Wurster | |
| 2013/0175236 | A1 | 7/2013 | Boukobza | |
| 2013/0180998 | A1* | 7/2013 | Nakayama | B65D 1/0284 220/609 |

* cited by examiner

VARIABLE VOLUME CONTAINER

CROSS-REFERENCE TO RELATED APPLICATION

This application claims the benefit of U.S. Provisional Application No. 61/785,130, filed Mar. 14, 2013.

FIELD OF THE INVENTION

The present invention relates generally to a variable volume container, and more particularly, to a container having a retractable diaphragm able to withstand the stresses imposed by positive and/or negative pressures within the container.

BACKGROUND OF THE INVENTION

For many years, plastic containers have done well in holding and conveying products to market. Containers used for food storage often have features to seal in product freshness. One such feature is a seal between the lid of the container and the container itself. This seal can add to the product freshness when the seal is used to reduce the air space between the food product and the top of the container.

Some containers have an added thin, heat-sealed film of plastic over the mouth of the container. These heat-sealed films have proven to be very good at sealing containers, but do not change the amount of bacteria already in the product inside the container at the time of sealing. Some container manufactures have added nitrogen gas under the film before heat-sealing to reduce food contamination. By adding nitrogen gas, growth of aerobic bacteria is reduced. However, the use of nitrogen gas is difficult to control and adds additional cost to the product. Eliminating any air space completely within the container would be a superior method if the container could withstand negative pressure without distorting the side wall or cracking the container. This pressure may cause the container to crack or break at weak points.

Another method of protecting a food product within a container is to introduce the film-sealed container to extremely high-pressure HPP (High Pressure Pasteurization) that kills the bacteria inside the product. The HPP method uses 90,000 pounds (~40,000 kilograms) of rapidly pulsing water pressure to destroy bacteria within the container. This method works well to extend the shelf life of the product, but can also crack and destroy a plastic container if it does not have features to accommodate extremely high and/or low pressures within the plastic container. Furthermore, HPP methods are costly to run in production.

Another new development in food safety and container technology is to place the container and product under a vacuum just before the container is closed with a heat-seal. Vacuum sealing plastic containers also works well at extending the shelf life of food products, but the disadvantage is that plastics, such as PET or polypropylene, distort easily under pressure, especially when the container walls are thin, leaving an aesthetically displeasing container after vacuum sealing.

Therefore, there remains a need to create containers that can withstand high pressure and vacuums that prevent side wall distortion, and cracking of the container and base of the container.

SUMMARY OF THE INVENTION

The present invention is directed to a container capable of reducing its interior volume when a vacuum or negative atmospheric pressure is applied to the container. The container is made to have two volume sizes, one in its original molded state and another after it has been vacuum-sealed. This change in volume of the container allows the air at the top of the container to be removed while the remaining contents reach a full vacuum condition. Regions of the bottom of the container rise due to negative pressure on top as the air is removed. The bottom of the container moves and prevents deformity of the container sidewalls. Even though the contents of the product are under a full vacuum, the container sidewalls and top retainer their normal appearance.

The present invention is a container having a tubular peripheral wall and a base. In a preferred embodiment, the base has a flexible diaphragm having a top surface and a bottom surface. The flexible diaphragm moves from a first position under normal atmospheric pressure to a retracted second position (toward the top of the container) under negative pressure. The base has a ribbed region having a plurality of concentric ribs adjacent the diaphragm. Each of the ribs has an interior curved surface and an exterior curved surface. In a preferred embodiment, between adjacent concentric ribs is a substantially flat-surfaced flexure zone, which acts as a hinge between two adjacent ribs. The flexure zone has an interior flexure surface and an exterior flexure surface, where the exterior flexure surface is shorter than the exterior flexure surface. The two flexure surfaces allow the ribs to twist and roll upward and downward in response to a change of the internal pressure of the container and prevents cracking of the base and prevents deformations from occurring at the sidewall. No mechanical or physical force is required to move the container bottom from its first position to its retracted position, rather the position of the bottom is due solely to the change of pressure in the container.

This container has several advantageous features. The container can be filled with a product, vacuum sealed, subjected to refrigeration, and maintain side wall integrity without distorting. The container can also be vacuum-sealed with its contents and put under high-pressure pasteurization without cracking.

BRIEF DESCRIPTION OF THE DRAWINGS

These and other features and advantages of the present invention will be appreciated as the invention becomes better understood with reference to the specification, claims, and drawings herein:

DETAILED DESCRIPTION OF THE DRAWINGS

Figure 1:
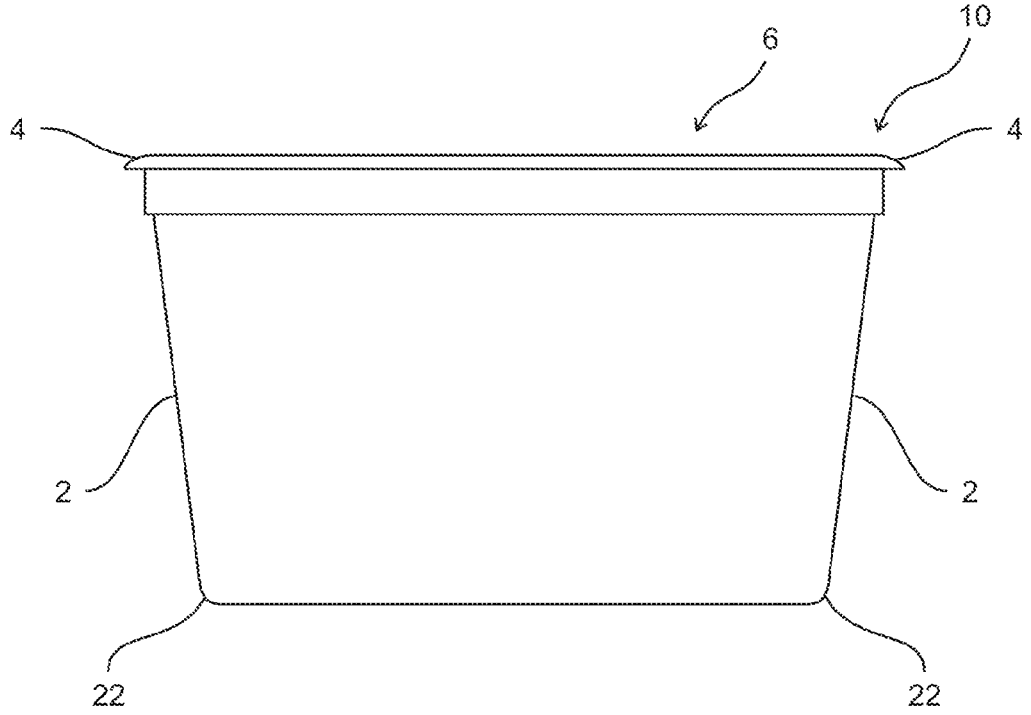
FIG. 1 is side view of variable container under either negative pressure or normal atmospheric pressure.
Figure 2:
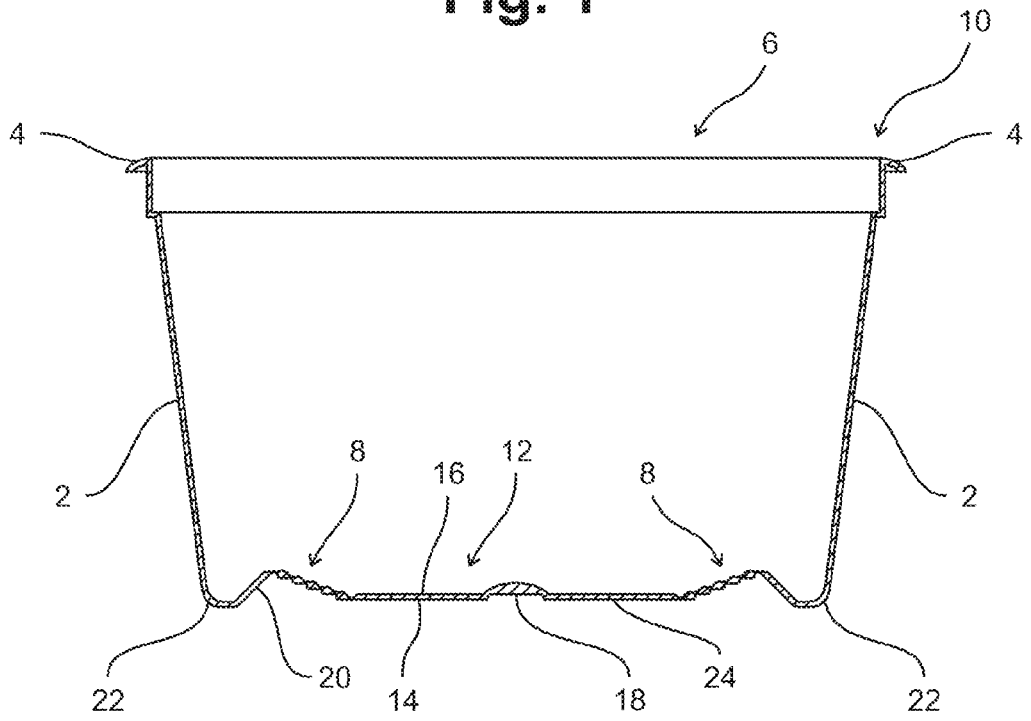
FIG. 2 is a cross section view of FIG. 1 under normal atmospheric pressure.
Figure 3:
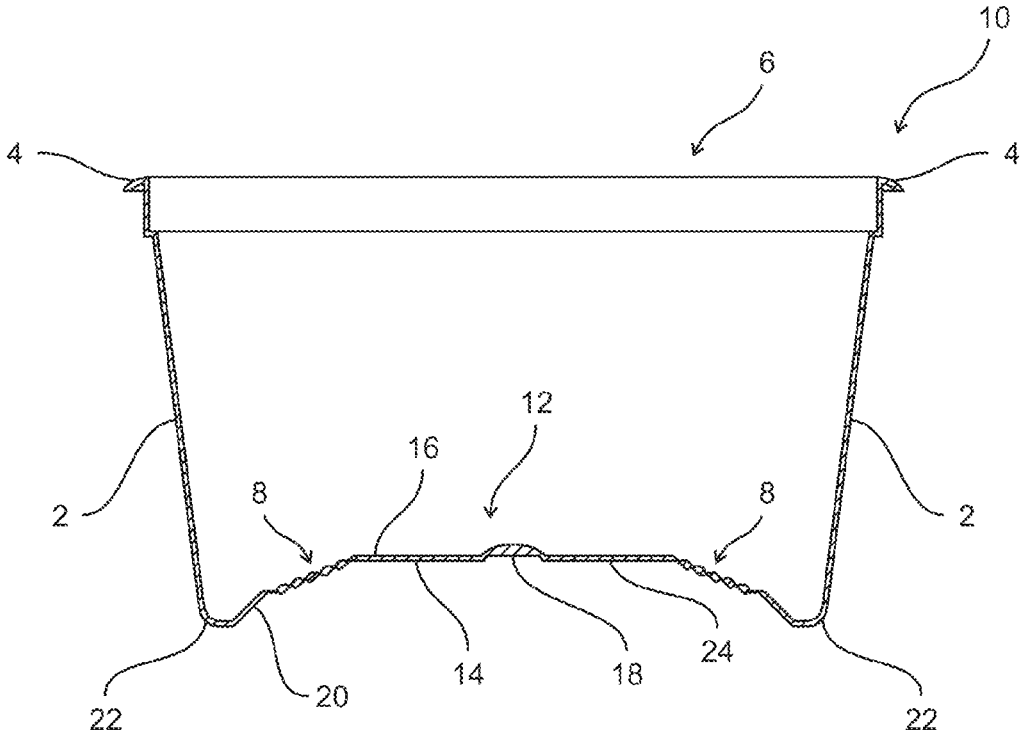
FIG. 3 is a cross section of the container of FIG. 1 under negative pressure.

FIG. 1 illustrates a side view of one embodiment of a variable volume container 10, which has the same external side and top appearance, whether or not the container 10 is under positive or normal atmospheric pressure (as illustrated in FIG. 2), or under negative pressure (as illustrated in cross sectional in FIG. 3). The variable volume container 10 has a base 12 that retracts from a lower plane position, illustrated in FIG. 2, to a high plane position (illustrated in FIG. 3) when there is a negative pressure imposed in the container 10. The container 10 has a tubular sidewall 2 extending upward peripherally from the base 12. The base 12 has a substantially flat diaphragm 24 in the center of the base 12, which is adjacent to a ribbed region 8 circumscribing the diaphragm 24. The ribbed region 8 is capable of moving in an accordion-like manner to allow the diaphragm 24 to retract upwards in the direction of the top 6 of the container under negative pressure, and protracts downward under positive or normal atmospheric pressure. The flexible diaphragm 24 is able to flex like a radio speaker in response to rapidly pulsating water pressure that occurs during HPP. This is advantageous because containers without flexing regions are more likely to crack in response to rapidly pulsating water pressure.

The container 10 has a weight bearing portion 22, forming the perimeter of the base 12 and connects the tubular sidewall 2 with the base 12 of the container 10. The bearing portion 22 allows the container 10 to rest on a table, shelf, or other platform while the diaphragm 24 can retract or protract without affecting the profile of the container 10, since the retracted and protracted positions of the diaphragm 24 are both above the horizontal plane formed by the bearing portion 22. The bearing portion 22 can be of any variety of sizes and shapes, but a flattened or rounded bearing portion 22 reduces the likelihood of cracking at corners of a container 10 when exposed to either positive or negative internal pressure. Extending from the bearing portion 22 is flange 20 that extends from the bearing portion 22 toward the central axis of the container 10. In a preferred embodiment, the flange 20 is a substantially flat annular region circumscribing the ribbed region 8 and connects the bearing portion 22 to the ribbed region 8.

The ribbed region 8 forms a plane that angles upward from the diaphragm 24 to the flange 20 under normal atmospheric pressure (as illustrated in FIG. 1), but angles downward from the diaphragm 24 to the flange 20 under negative pressure (as illustrated in FIG. 2). In a preferred embodiment, under normal atmospheric pressure, the ribbed region 8 angles upward approximately between 5 degrees and 40 degrees from the diaphragm 24. In a more preferred embodiment, the ribbed region 8 is at an approximately 20 degree angle from the horizontal plane of the diaphragm 24. In one embodiment, by having the ribbed region 8 at a preferred angle with respect to the diaphragm 24, the ribbed region 8 is capable of maintaining the diaphragm 24 in its new retracted position after the diaphragm 24 has retracted into its new position under negative pressure. The smaller the angle between the ribbed region 8 and the diaphragm 24, the less displacement occurs in response to pressure changes.

Figure 7:
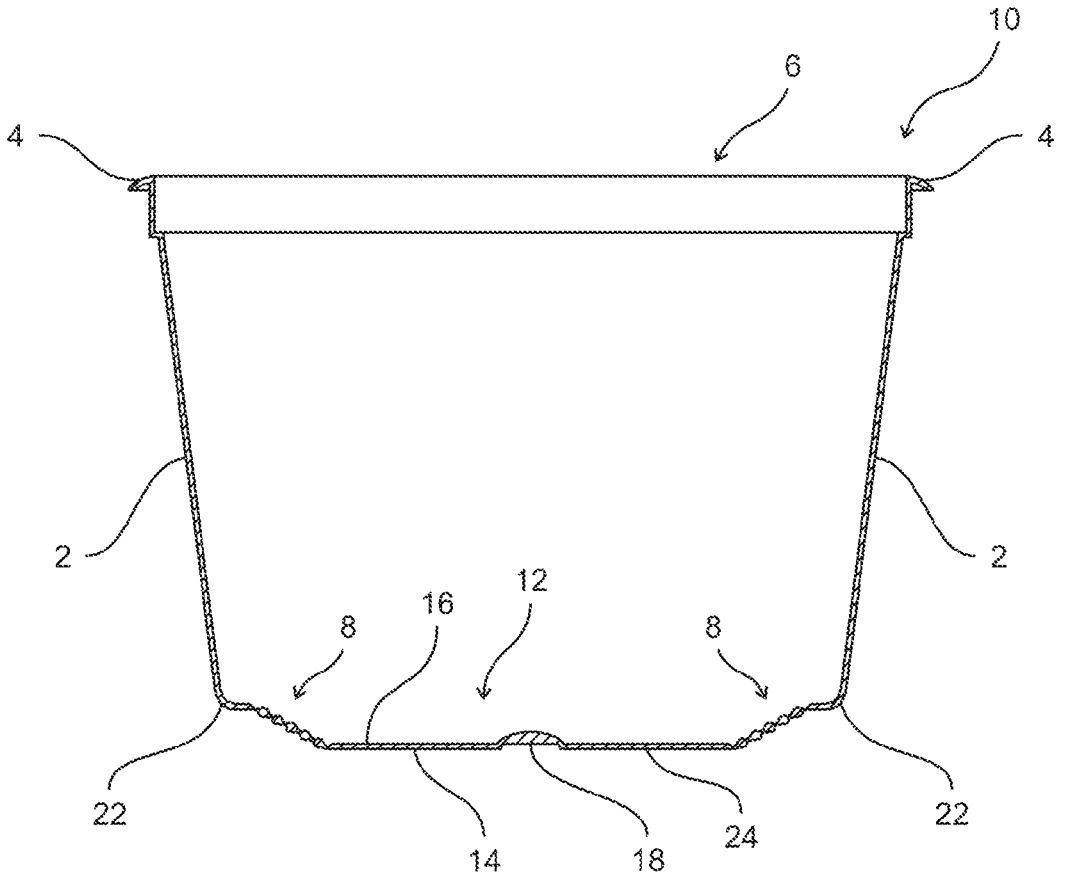
FIG. 7 is a cross sectional view of another embodiment of a variable volume container.

The ribbed region 8 is able to flex in an upward (retracted) direction without causing strain on the bearing portion 22, thereby preventing cracking of the container 10 when the base 12 moves from a first position (as shown in FIG. 1) to a second retracted position (as shown in FIG. 2). The retraction of the base 12 in FIG. 2 occurs when a vacuum is applied to the top 6 of the container. The ribbed region 8 is comprised of individual ribs 8*a*, 8*b* that allow the base 12 to retract upwards and protract downward. In one embodiment, the diaphragm 24 is above the plane formed by the bearing portion 22 of the container 10 regardless of whether the contents of the container 10 are under vacuum pressure or normal pressure, as illustrated by the embodiments shown in FIGS. 1-4. In another embodiment, illustrated in FIG. 7, the diaphragm 24 has a horizontal plane below the bearing portion 22 when under normal atmospheric pressure, but retracts above the horizontal plane formed by the bearing portion 22 when under negative pressure.

Optionally, the diaphragm 24 can have a nose cone 18 which may be used as the injection gate when injection molding the container. In various embodiments, the nose cone 18 is located along the central longitudinal axis of the container 10 and is operative to move up or down in response to changes in atmospheric pressure without substantially deforming as it moves upward and/or downward with the diaphragm 24. The flange 20 and the ribbed region 8 are constructed to be cooperatively operative so as to prevent the diaphragm 24 from moving downward beyond a predetermined point of recovery, and the diaphragm 24 and flange 20 are constructed to be cooperatively operative such that the diaphragm moves back down after upward movement to a position at its initial, as formed position. The plurality of ribs 8*a*, 8*b*, are also constructed to operative to prevent the diaphragm 24 from moving upward beyond a predetermined point of recovery, and operative to prevent the diaphragm 24 from moving downward beyond a predetermined point of recovery.

The ribbed region 8 is comprised of a plurality of ribs 8*a*, 8*b* disposed on the upper surface 16 and lower surface 14 of the base 12. The ribs 8*a*, 8*b* have different structural features on the upper surface 16 and lower surface 14 that aid in creating a superior flexible region, details of which are illustrated in FIGS. 4, 5, and 6, and described below.

Figure 4:
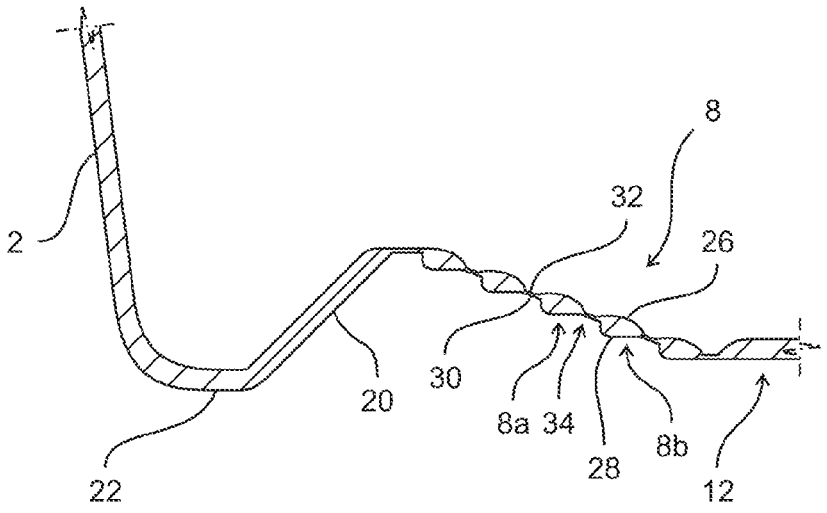
FIG. 4 is a cross section view of a portion of the base of the container in FIG. 1.
Figure 5:
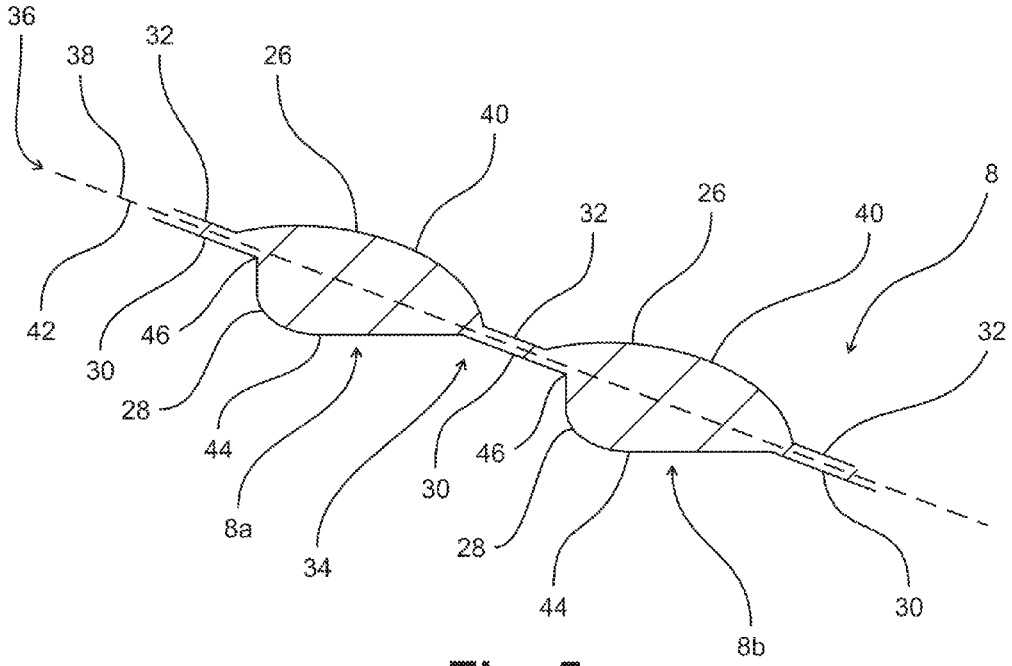
FIG. 5 is a cross section view of the ribs and flexure zones of the base of the container in FIG. 1.
Figure 6:
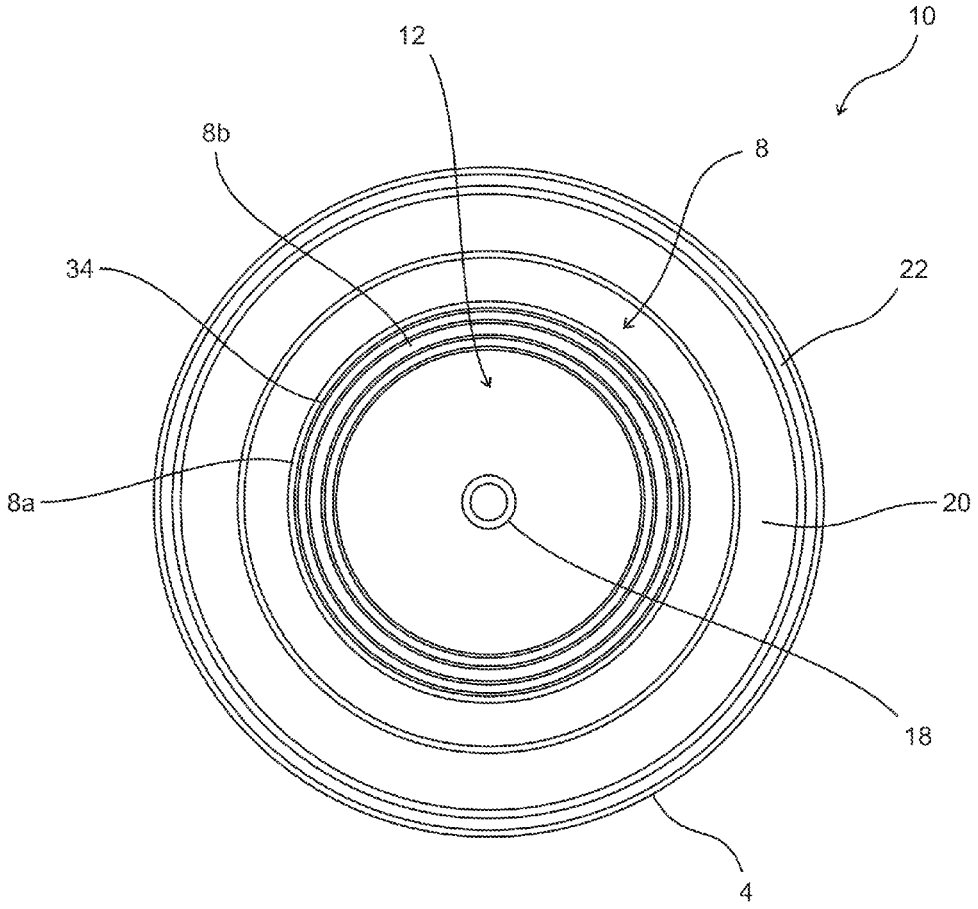
FIG. 6 is a bottom view of the container of FIG. 1.

FIGS. 4 and 5 illustrate enlarged views of the base 12 of the container 10 illustrated and described in FIGS. 1-3. The ribbed region 8 has a plurality of ribs 8*a*, 8*b*. Connecting each rib 8*a*, 8*b* is a flexure zone 34 having a interior surface 32 and an exterior surface 30. In various embodiments, the interior surface 32 of the flexure zone 32 is shorter than the exterior surface 30 of the flexure zone 34. In a preferred embodiment, the exterior surface 30 is between 1.5 and 3.0 times of the length the interior surface 32. This design may be accomplished by using a plastic injection molding process and may use core and a cavity in a model mold to create thick ribs 8*a*, 8*b*, and thin flexure zones 34 between each of the ribs 8*a*, 8*b*. The thin flexure zones 34 act as hinges to facilitate the retraction of the diaphragm 24 by allowing the ribs 8*a*, 8*b* to roll into a retracted, or inverted, position. The flexure zones 34 also act as gates that restrict the plastic flow during production of the container 10. This difference between the length of the interior surface 32 and exterior surface 30 of the flexure zone 34 allows for better maintenance of the plastic flow through the flexure zone 34, even if the core shifts during production. Thin flexure zones 34 and thick ribs 8*a*, 8*b* also act in concert to keep the restriction of plastic flow at a minimum. As the plastic of the mold restricts at the thin flexure zone 34, the plastic immediately flows into a larger rib 8*a*, 8*b*. The number of flexure zones 34 and ribs 8*a*, 8*b* is a minimum of two each, but any number of flexure zones 34 and ribs 8*a*, 8*b* to allow the diaphragm 24 to move can be used in various embodiments.

When in the normal position before negative pressure is applied, the ribbed region 8 of the diaphragm 24 defines a curved conical plane or frustum 36, as shown in an enlarged view of the ribbed region 8 in FIG. 5. The conical plane 36 has an interior side 38 and an exterior side 42. The surface of the ribs 26 on the interior side 38 of the conical plane 36 are curved. The arc of the interior curve 26 of the ribs 8*a*, 8*b* is substantially uniform with the approximate midpoint 40 of the interior curve 26 being the greatest distance from the conical plane 36. The surface of the ribs 28 on the exterior side 42 of the conical plane 36 are also curved. But critically, the shapes of the interior 26 and exterior curves 28 are different. While the interior curve 26 has a uniform arc, the arc of the exterior curve 28 is distorted. The distortion of the exterior curve 28 can be defined as follows: The zenith of the exterior curve 28 of the rib 8*a*, 8*b* that is the greatest distance from conical plane 36 is between the midpoint of the exterior curve 44 and the end 46 of the curve closest to the sidewall 2 of the container. This structural difference is important to the superior performance characteristics of the invention.

In a preferred embodiment, the ribs 8*a*, 8*b* at their thickest regions are four to eight times the thickness of the flexure zone 34 between the ribs 8*a*, 8*b*. In other embodiments, the thickness of the ribs 8*a*, 8*b*, flexure zones 34, and diaphragm 24 may allow the diaphragm 24 to stay in a retracted position even after the pressure in the container returns to normal.

There are several ways to mold the variable volume container having the ribbed region 8 and thin flexure zones 34. The mold may be open enough to fill the mold completely with plastic during the injection process, whereby the mold then closes together forming the thin sections of the container. In an alternative way to create the container, the container 10 may be molded in either the retracted (inverted) or non-retracted configuration. If the container 10 is molded in the retracted position, then air is applied to the core head of the mold so that the base 12 of the container air blown into an extended position. After the bottom of the container is in its fully extended position, the container 10 is ejected from the mold.

Containers can be made from various materials, and have various thicknesses. In a preferred embodiment, the container is made from a plastic material such as a copolymer polypropylene material, which is both strong and flexible. In a preferred embodiment, the plastic is comprised of a polypropylene random co-polymer, which can be supplied from several sources, such as the co-polymer having the trade name Pro-Fax SR549M. In a preferred embodiment, the wall 2 of the container 10 has a minimal thickness needed relative to the flexure zones 34 to insure that the flexure zones 34 allow for retraction of the diaphragm 24 before any deformation of the side wall 2. In a preferred embodiment, the wall thickness is between 0.026 inches (0.66 mm) and 0.035 inches (0.89 mm), and in a more preferred embodiment is approximately 0.030 inches (0.76 mm). In a preferred embodiment, the bearing portion 22 should have a thickness of an additional 0.005 inches (0.13 mm) to 0.015 inches (0.38 mm) compared to the side wall 2 thickness in order to achieve the preferential retraction of the ribbed region 8, instead of causing the collapse of the side wall 2.

Optional features of the container 10 include a lip 4 for securing or snapping on a lid to the top 6 of the container 10. To hermetically seal the container 10, a sealing film (not illustrated) may be placed over the top 6 of the container 10 and sealed by any number film-sealing means well known in the art.

While the invention has been described in terms of exemplary embodiments, it is to be understood that the words that have been used are words of description and not of limitation. As is understood by persons of ordinary skill in the art, a variety of modifications can be made without departing from the scope of the invention defined by the following claims, which should be given their fullest, fair scope.

I claim:

1. A variable volume container comprising:

a) a tubular sidewall, b) a base integral with the side wall, the base having:

i) a flexible diaphragm having a top surface and bottom surface, wherein said flexible diaphragm is in a first position under normal atmospheric pressure, and capable of moving to a retracted second position in response to negative pressure in the container;

ii) a ribbed region having a plurality concentric ribs circumscribing said flexible diaphragm; and, iii) a flexure zone joining adjacent concentric ribs, said flexure zones having an interior flexure surface and an opposing exterior flexure surface, wherein said interior flexure surface is shorter than said exterior flexure surface, and wherein said flexure zone has a thickness less than the thickness of said plurality of concentric ribs.

2. The container of claim 1, wherein said ribbed region is capable of being aligned on a conical plane wherein each of said plurality of ribs has an interior curved surface that has a substantially uniform arc and each of said plurality of ribs has an exterior curved surface that defines an arc that is distorted toward said tubular sidewall.

3. The container of claim 1, wherein said ribbed region is capable of being aligned on a conical plane wherein each of said plurality of ribs has an interior curved surface and an exterior curved where the point on said interior curved surface farthest from the conical plane is located approximately at a midpoint of the interior curved surface; and, the point on the exterior curved surface farthest from the conical plane is located between a midpoint of the exterior curved surface and an end of the exterior curved surface closest to the sidewall of the container.

4. The container of claim 1, wherein said flexure zone is substantially flat, and said exterior flexure surface is approximately between 1.5 to 3.0 times the length of said interior flexure surface, and each of said plurality of ribs has a thickness of approximately between 4.0 to 8.0 times the thickness of said flexure zone.

5. The container of claim 1, wherein said base further comprises a bearing portion, and one side of said bearing portion is integrally formed with said tubular sidewall, and a second side is integrally formed with a flange connecting said ribbed region to said bearing portion.

6. The container of claim 1, wherein said ribbed region extends upwardly at an angle between approximately 5 degrees and 40 degrees from the horizontal plane formed by said diaphragm when the container under a negative internal pressure.

7. The container of claim 6, wherein said ribbed region extends upwardly at an angle of approximately 20 degrees from the horizontal plane formed by said diaphragm when the container has a negative internal pressure.

8. The container of claim 1, wherein said ribbed region and said flange are constructed to be cooperatively operative so as to prevent said diaphragm from moving downward beyond a predetermined point of recovery.

9. The container of claim 8, wherein said diaphragm and said flanges are constructed to be cooperatively operative such that the diaphragm moves back down after upward movement to a position at its initial, as formed position.

10. The container of claim 1, wherein said plurality of ribs are constructed and operative to prevent said diaphragm from moving upward beyond a predetermined point of recovery, and operative to prevent said diaphragm from moving downward beyond a predetermined point of recovery.

11. A variable volume container comprising:

a tubular sidewall, a base integral with the side wall, the base having:

i) a flexible diaphragm having in a first position under normal atmospheric pressure, and operative to move to a retracted second position in response to negative pressure in the container;

ii) a ribbed region having a plurality concentric ribs circumscribing flexible diaphragm, each of said concentric ribs having an interior curved surface and an exterior curved surface;

iii) a flexure zone joining adjacent concentric ribs, said flexure zones having a top flexure surface and an opposing bottom flexure surface, wherein said top flexure surface is shorter than said bottom flexure surface, and wherein said flexure zone has a thickness less than the thickness of said plurality of concentric ribs;

said ribbed region is capable of being aligned on a conical plane wherein each of said plurality of ribs has an interior curved surface and an exterior curved where the point on said interior curved surface farthest from the conical plane is located approximately at a midpoint of the interior curved surface; and, the point on the exterior curved surface farthest from the conical plane is located between a midpoint of the exterior curved surface and an end of the exterior curved surface closest to the sidewall of the container.

12. A variable volume container comprising:

a tubular sidewall, a base integral with the side wall, said base including a bearing portion, where one side of said bearing portion is integrally formed with said tubular sidewall, and a second side is integrally formed with a flange connecting said ribbed region to said bearing portion, the base further including:

i) a flexible diaphragm having in a first position under normal atmospheric pressure, and operative to move to a retracted second position in response to negative pressure in the container;

ii) a ribbed region having a plurality concentric ribs circumscribing flexible diaphragm, each of said concentric ribs having an interior curved surface and an exterior curved surface, said ribbed region is capable of being aligned on a conical plane where the point on said interior curved surface farthest from the conical plane is located approximately at a midpoint of the interior curved surface, and the point on the exterior curved surface farthest from the conical plane is located between a midpoint of the exterior curved surface and an end of the exterior curved surface closest to the sidewall of the container; and, iii) a flexure zone joining adjacent concentric ribs, said flexure zones having a top flexure surface and an opposing bottom flexure surface, wherein said top flexure surface is shorter than said bottom flexure surface, and said flexure zone has a thickness less than the thickness of said plurality of concentric ribs, said flexure zone is substantially flat, and said bottom flexure surface is approximately between 1.5 to 3.0 times the length of said bottom flexure surface, and each of said plurality of ribs has a thickness of approximately between 4.0 to 8.0 times the thickness of said flexure zone.

* * * * *